United States Patent [19]

Hart

[11] Patent Number: 4,635,453

[45] Date of Patent: Jan. 13, 1987

[54] LOCK SET

[75] Inventor: Leroy Hart, Farmington, Conn.

[73] Assignee: Emhart Industries, Inc., Farmington, Conn.

[21] Appl. No.: 838,333

[22] Filed: Mar. 13, 1986

[51] Int. Cl.[4] ..... E05B 55/00; E05C 1/12

[52] U.S. Cl. ..... 70/134; 70/150; 70/380; 292/169.14; 292/169.22

[58] Field of Search ..... 70/134, 224, 467–485, 70/379 R, 380, 151 R, 150, 152–153; 292/169.14, 169.15, 169.16, 169.17, 169.21, 169.22

[56] References Cited

U.S. PATENT DOCUMENTS

| | | | |
|---|---|---|---|
| 1,662,423 | 3/1928 | Jacobi | 70/379 R |
| 1,845,867 | 2/1932 | Ellingson | 70/379 R |
| 2,738,666 | 3/1956 | Tornoe | 70/468 |
| 2,998,274 | 8/1961 | Russell | 70/467 |
| 3,819,214 | 6/1974 | Hart | 70/151 R |
| 4,428,212 | 1/1984 | Best | 70/380 |

*Primary Examiner*—Robert L. Wolfe

*Attorney, Agent, or Firm*—Barry E. Deutsch

[57] ABSTRACT

A lock set comprises a housing having a latch bolt assembly supported therewithin. The bolt assembly includes a bolt movable between latched and retracted positions. A retractor slide is connected to the bolt and is supported by the housing for longitudinal sliding movement relative thereto between bolt retracted and latching positions. Axially movable and rotatable first drive member extends transversely of the direction of movement of the bolt and is engaged with the retractor slide for movement thereof between the bolt retracted and latched positions. The first drive member includes a locking surface. An operating assembly comprises a hand operator having a locking slot formed in an axially extending portion thereof. A cylinder having a plug portion is disposed within the hand operator, the plug portion being rotatable relative thereto. A non-rotatable sleeve is radially sandwiched between the hand operator and the first drive member and includes a radially movable retainer aligned with the locking slot and normally extending therethrough for locking the hand operator to the sleeve. The locking surface of the first drive member is radially aligned with the retainer for maintaining the retainer within the slot. A second drive member is operatively connected to the rotatable plug and to the first drive member. Rotation of the plug results in actuation of the second drive member to move the first drive member axially to radially displace the locking surface relative to the retainer member.

14 Claims, 5 Drawing Figures

LOCK SET

BACKGROUND OF THE INVENTION

This invention relates in general to lock sets and more particularly relates to the addition of a hotel function to a lock set without materially increasing the cost of manufacturing the lock set.

It is known that lock sets have different functions which require the lock sets to operate in slightly different ways for each specific function. For example, the typical lock set used on an entry door controlling egress and ingress into a building may be placed in either locked or merely latched modes of operation. When such a lock is in its latched mode, either the inside or outside hand operator, typically a knob or lever, may be turned to retract the latch bolt.

The identical lock set cannot generally be used to perform a hotel function. When a lock set is used on the door of a hotel room or the like, the outside or exterior hand operator is generally maintained in a fixed position; i.e., prevented from rotating relative to the door. This feature increases the security of the room since, even when the inside hand operator is unlocked, only a person with a key can gain access from the exterior of the room, since movement of the latch bolt is solely responsive to rotation of the plug of the lock cylinder.

In some instances, it may be desirable to change the lock cylinder so that entry into the hotel room may only be gained by someone having a key to fit a new cylinder. Changing the cylinder is commonly referred to as "rekeying". Any person only having a key fitting the removed cylinder, will not be able to gain entry into the hotel room. In some lock sets, the outside hand operator must be removed before the lock cylinder can be removed for replacement thereof. Removal of the hand operator often necessitates its rotation; as indicated previously the rotation of the outside hand operator is prevented in lock sets performing a hotel or similar function.

Very often, in order to convert a standard lock set used on an entry door to a building or room, to a lock set suitable for use in a hotel application, significant changes must be made. By making significant changes to the design of a lock set, the number of interchangeable parts between a standard lock set and a hotel lock set is reduced and the manufacturing costs and inventory costs of each of the lock sets are increased.

Accordingly, it is an object of this invention to convert a standard lock set to a lock set suitable for use in a hotel function by implementing a minimal number of changes to parts of the standard lock set.

SUMMARY OF THE INVENTION

The foregoing object and other objects of the invention are attained in a lock set comprising a housing member; a latch bolt assembly including a bolt movable between latching and retracted positions; retractor means supported by said housing member for reciprocal movement relative thereto between latching and retracted positions and connected to the bolt for moving the bolt between its positions upon reciprocal movement thereof; axially movable and rotatable first drive means extending transverse of the direction of movement of the bolt and engaged with the retractor means for producing reciprocal movement thereof, said drive means including a locking surface; and an operating assembly comprising a hand operator having a locking slot formed in an axially extending portion thereof, locking means disposed within the hand operator including a plug portion rotatable relative to the hand operator, a nonrotatable sleeve radially sandwiched between said hand operator and said first drive means including a radially movable retainer member aligned with the locking slot and normally extending therethrough for locking said hand operator to said sleeve, the locking surface of said drive means being radially aligned with said retainer member for maintaining the retainer member within the slot, and second drive means operatively connected to the rotatable plug and the first drive means, with rotation of the plug resulting in actuation of the said second drive means to move said first drive means axially to displace the locking surface relative to the retainer means.

The present invention further relates to a motion producing mechanism for use in a lock set comprising a rotatable plug having an axially extending spiral-shaped cam surface disposed at one end thereof; and a rotatable roll back member having a radial slot at an end thereof facing toward the cam of the first member, with the cam surface extending within the slot whereby initial rotation of the plug causes the spiral-shaped cam surface to drive the roll back member axially away from the plug and continued rotation of the plug causes rotation of the roll back member.

DETAILED DESCRIPTION OF THE PREFERRED EMBODIMENT

Figure 1:
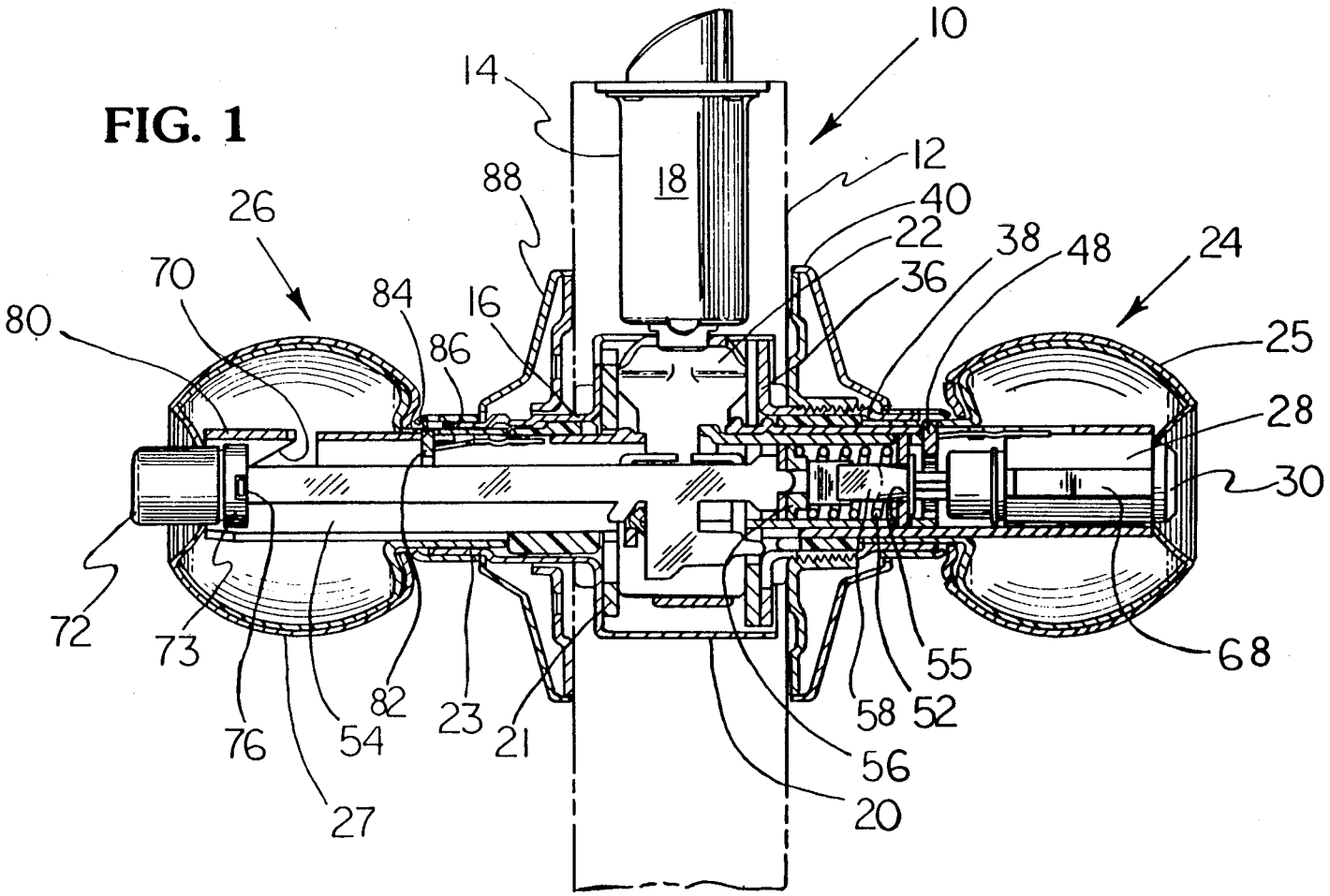
FIG. 1 is a horizontal sectional view of the lock set including the present invention.
Figure 2:
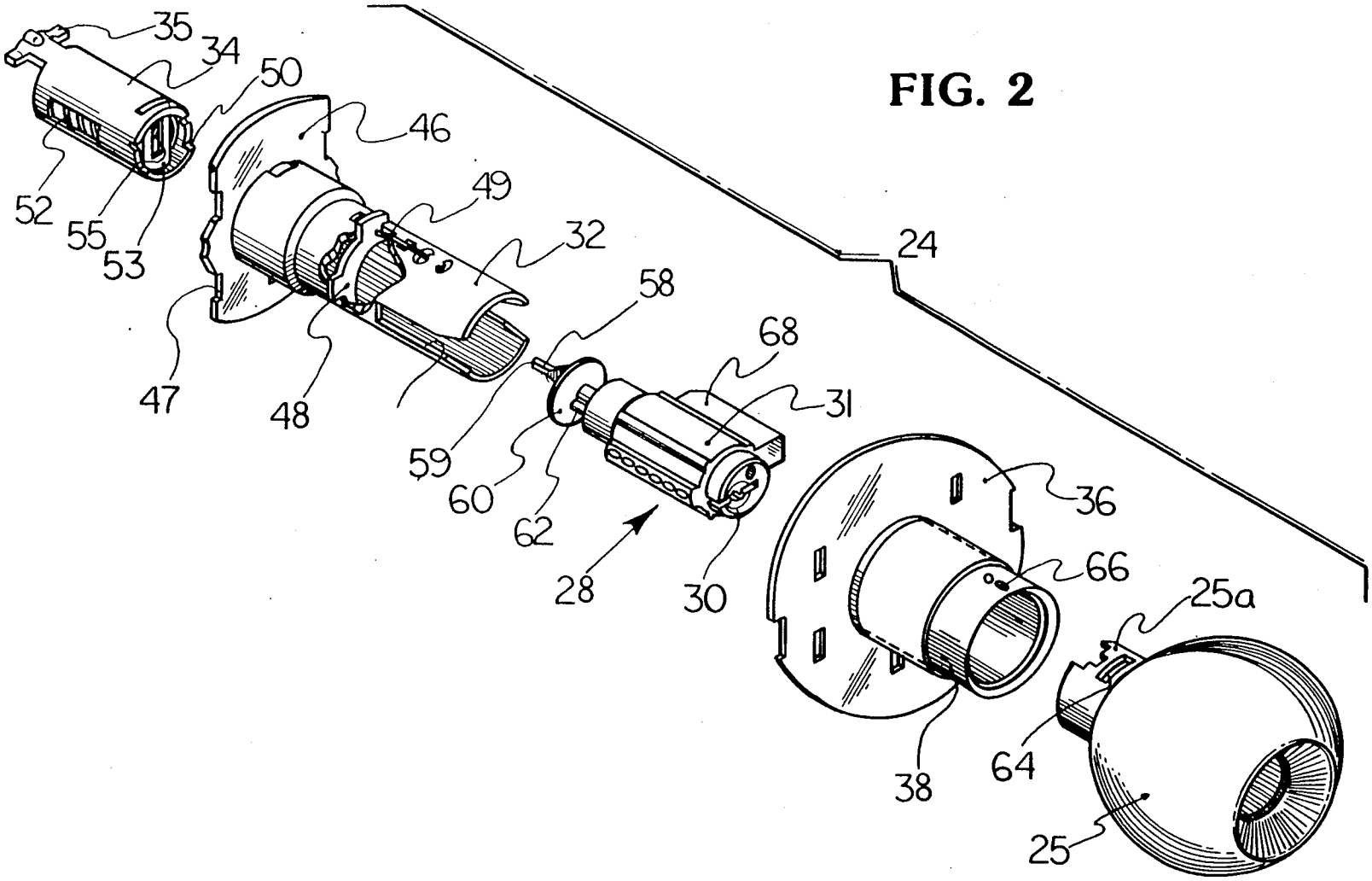
FIG. 2 is an exploded perspective view of the components forming the outside operating assembly of the lock set.
Figure 3:
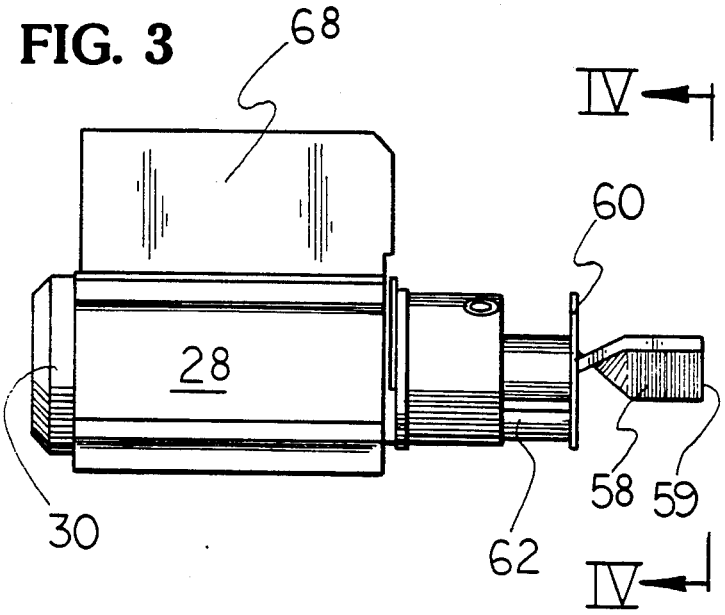
FIG. 3 is a side elevational view of a cylinder and plug in accordance with the present invention.
Figure 4:
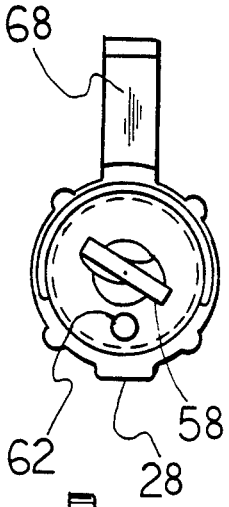
FIG. 4 is a sectional view taken along lines IV—IV of FIG. 3.

Referring now to the drawing, there is disclosed a preferred embodiment of the present invention as embodied within a cylindrical lock set. In referring to the various Figures of the drawing, like numerals shall refer to like parts.

A lock set, generally designated 10, is disposed within a pair of transversely oriented bores 14,16 provided within door 12 shown in phantom. Lock set 10 includes a latch bolt 18 mounted for reciprocal movement within bore 14. Bolt 18 is connected to a retractor mechanism 22 mounted for reciprocating movement within frame 21. Frame 21 in turn is mounted within a generally cylindrical housing 20.

Lock set 10 further includes an outside operating assembly 24 and an inside operating assembly 26. As will be explained in greater detail hereinafter, lock set 10 is specifically designed for use in a hotel or similar application. Accordingly, outside operating assembly 24 is mounted on the exterior of door 12, with door 12 controlling entry into a hotel room. Inside operating assembly 26, in turn, is mounted on the interior of the door, to allow the occupant thereof to open the door for leaving the room. Outside operating assembly 24 includes a knob or other hand operator 25. Likewise, inside operating assembly 26 includes a knob or other hand operator 27. A lock cylinder 28 is disposed within knob 25 and includes plug 30. Plug 30 is rotatable relative to the outer housing 31 of cylinder 28 as is well-known to those skilled in the art. Cylinder 28 includes a radially upstanding leg 68, axially extending spiral-shaped cam surface 58, a plate 60 mounted on cam 58 for axial movement relative thereto, and a spring loaded pin 62 urging plate 60 towards end 59 of cam surface 58. The function of the foregoing parts shall be more fully explained hereinafter.

Outside operating assembly further includes a generally cylindrical flange 36 having a threaded axial extension 38. Extension 38 includes a hole 66 formed therein for a reason to be more fully explained hereinafter. Threaded extension 38 faces towards and fits over a complementary axial extension 25*a* of outside knob 25. Knob extension 25*a* includes a slot 64 formed therein. Slot 64 and hole 66 are radially aligned when knob 25 and flange 36 are joined together by telescoping extension 25*a* within extension 38. A rose or escutcheon 40 is threadably mounted on extension 38.

Operating assembly 24 further includes an outside roll back 32 comprising a generally axially extending cylindrical member. Roll back 32 includes a U-shaped retainer clip 48 which is urged radially outward by spring 49. When assembled, retainer 48 extends outwardly into slot 64 to retain knob 25 on roll back 32. Roll back 32 further includes at least one axially extending slot 33. Slot 33 is provided to accept leg 68 of cylinder 28. A similar slot (not shown) is provided in extension 25*a* of knob 25. A stationary face plate 46 is mounted on one end of roll back 32. To accommodate the hotel function, face plate 46 is staked or otherwise rigidly affixed to roll back 32 to form a unitary assembly. For most other functions, roll back 32 is unrestrained relative to face plate 46 to permit relative rotation between the parts. Face plate 46 is provided with detent slots 47 which accept axial extensions from frame 21. As frame 21 is positioned in fixed relationship within housing 20, the mounting of face plate 46 on frame 21 prevents movement of the face plate and likewise restrains movement of roll back 32. The foregoing construction is all conventional within the art.

Outside operating assembly 24 further includes an auxiliary roll back 34. Roll back 34 includes operating ears 35 which engage retractor mechanism 22 which results in reciprocal movement of the mechanism within frame 21 upon rotation of roll back 34. Again the foregoing construction is conventional within the art. For further details of such construction, reference may be had to U.S. Pat. No. 3,819,214, issued June 25, 1974, Leroy Hart, Thomas Salonia, and Gary R. Bergen, inventors.

Roll back 34 includes a generally U-shaped ledge 50 functioning as a locking surface. In normal assembly, as particularly illustrated in FIG. 5, when the auxiliary roll back is placed within main roll back 32, ledge 50 is placed radially beneath U-shaped retainer 48 to prevent the retainer from being depressed or moved radially inward. Roll back 34 further includes a slide plate 56 (see FIG. 1) positioned at the end adjacent ears 35. The slide plate is urged in the direction of the ears by spring 52. Spring 52 is captured on its reverse end by backing plate 53. Plate 53 includes a radially extending slot 55. When assembled as shown in FIG. 1, cam surface 58 extends axially within slot 55. As shall be more fully explained hereinafter, the inventive feature is embodied within the outside operating assembly 24. Accordingly, only a brief description of the inside operating assembly 26 will now follow.

Inside operating assembly 26 includes inside knob 27. The inside knob surrounds an axially extending locking bar 54. Turn button 72 is positioned on the end of the locking bar and includes a turn button washer 73. A radially extending lug 76 projects from washer 73. A main roll back 80, similar in structure to roll back 32, is rotatably mounted about locking bar 54. The end of roll back 80 adjacent turn button 72 includes a slot 70. Slot 70 includes an axially extending portion and a circumferential locking portion. Radial lug 73 projects within slot 70, with the position of the lug being determined by the axial position of locking bar 54. Roll back 80 includes radially projecting retainer member 82 which is urged into a slot 84 formed in an axial extension 86 of knob 27. The foregoing structure locks the knob to the roll back. Housing 20 includes an axially extending portion 23 projecting towards inside knob 27. Inside operating assembly 26 includes a rose or escutcheon 88 bearing against the inside door face.

As the actual operation of lock set 10 is conventional within the art, for the purposes of brevity, only a very short description will follow. Suffice it is to say that inside main roll back 82 and auxiliary roll back 34 are independently operable in response to rotation of, respectively, inside knob 27 and plug 30. When inside knob 27 rotates, the inside main roll back 80 will likewise rotate causing reciprocal movement of retractor mechanism 22 to retract latch bolt 18. The rotation of the inside knob does not result in any simultaneous rotation of auxiliary roll back 34 and/or plug 30. Likewise, rotation of the plug will cause concomitant rotation of auxiliary roll back 54, with such motion causing retractor mechanism 22 to reciprocally move to retract latch bolt 18.

Figure 5:
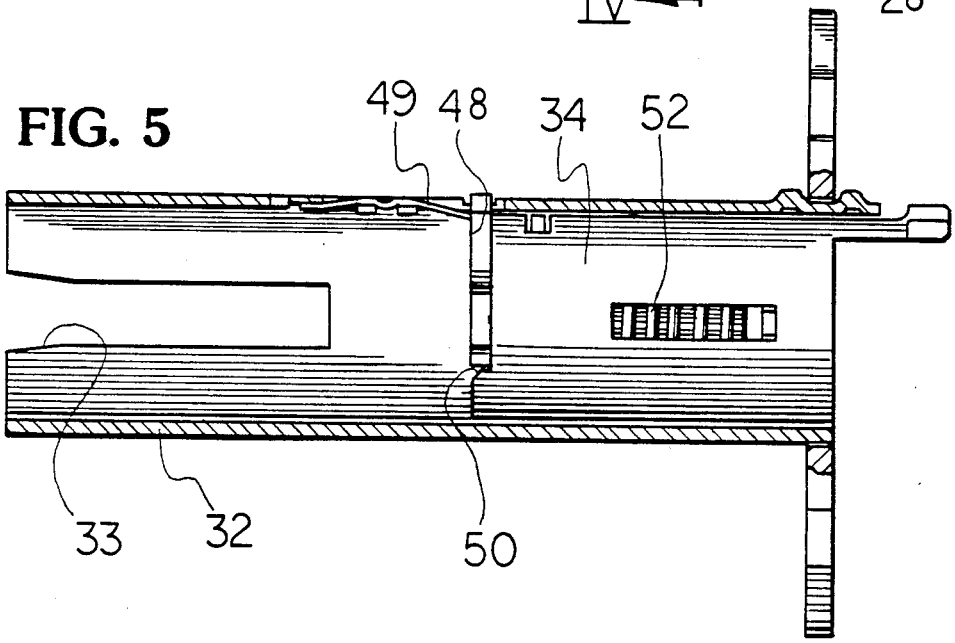
FIG. 5 is an enlarged sectional view of a specific feature of the lock set of the present invention.

As previously discussed, it is sometimes desirable to rekey the outside operating assembly. Any rekeying operation necessitates the replacement of cylinder 28 by a new cylinder. Lock set 10 embodying the present invention is used in a hotel or similar function wherein it is desired to maintain security within a room or other enclosure so that irrespective of whether the inside knob is locked, the outside knob is maintained fixed or non-rotatable, thereby only permitting access into the room to someone having a key to rotate the plug. As the locking retainer member 48 in roll back 32 and slot 64 in knob 25 are maintained in radial alignment, with a retainer member 48 projecting upwardly from the roll back into the slot, it was recognized that means must be provided to insure that an unauthorized person could not remove the knob to overcome the security of the lock. To prevent knob 25 from being removed by an unauthorized person, the present invention includes means to maintain retainer 48 within slot 64 of knob 25. Such means includes the U-shaped locking surface or ledge 50 formed on one end of auxiliary roll back 34. As illustrated in FIG. 5, it will be noted that ledge 50 fits directly beneath retainer 48 when outside operating assembly 24 is in its locked state. When thus positioned, retainer 48 is physically maintained in its projected state with respect to slot 64 to insure that knob 25 is retained on roll back 32. Spring 52 provides a force to axially maintain ledge 50 in radial alignment with retainer 48 in the absence of a key rotating plug 30.

If it is desired to remove the knob to rekey the lock set, a key is inserted into plug 30 to rotate the same.

Rotation of the plug results in simultaneous rotation of cam surface 58 connected thereto. As noted previously, cam 58 extends within radial slot 55 formed in backing plate 53 of auxiliary roll back 34. By rotating the spiral-shaped cam surface 58, the cam functions as a drive member and develops a force to axially drive the roll back away from the plug or towards the center of the lock set. By moving the auxiliary roll back in an axial direction, locking surface 50 of the roll back is displaced axially with respect to retainer 48, thus enabling the retainer to be forced inwardly with respect to slot 64. A tool is inserted through hole 66 to depress retainer 48. Once the retainer has been forced inwardly with respect to slot 64, the knob 25 is no longer secured to roll back 32 and thus may be removed therefrom.

The present invention provides a non-complex, easily manufactured and relatively inexpensive means for adding a hotel function to a standard lock set.

While a preferred embodiment of the present invention has been described and illustrated, the invention should not be limited thereto but may be otherwise embodied within the scope of the following claims.

What is claimed is:

1. A lock set for a door comprising:

a housing member;

a latch bolt assembly including a bolt movable between latching and retracted positions;

retractor means supported by said housing member for reciprocal movement relative thereto between latching and retracted positions and connected to said bolt for moving said bolt between its positions upon reciprocal movement thereof;

axially movable and rotatable first drive means extending transverse of the direction of movement of said bolt and engaged with said retractor means for producing reciprocal movement thereof, said first drive means including a locking surface; and an operating assembly comprising a hand operator having a locking slot formed in an axially extending portion thereof, locking means disposed within said hand operator including a plug portion rotatable relative thereto, a non-rotatable sleeve radially sandwiched between said hand operator and said first drive means including a radially movable retainer member aligned with said locking slot and normally extending therethrough for locking said hand operator to said sleeve, the locking surface of said first drive means being radially aligned with said retainer member for maintaining said retainer member within said slot, and second drive means operatively connected to said rotatable plug and said first drive means with rotation of said plug initially resulting in actuation of said second drive means to move said first drive means axially to displace said locking surface relative to said retainer means.

2. A lock set in accordance with claim 1 wherein said first drive means includes a radially extending slot and said second drive means includes an axially extending cam surface disposed within said slot with rotation of said plug moving said cam surface relative to said slot to furnish a force to move said first drive means axially.

3. A lock set in accordance with claim 2 including spring means attached to said retainer member for urging said retainer member radially into said locking slot.

4. A lock set in accordance with claim 3 wherein said cam surface is spiral-shaped.

5. A lock set in accordance with claim 2 wherein said cam surface is spiral-shaped.

6. A lock set in accordance with claim 1 including spring means attached to said retainer member for urging said retainer member radially into said locking slot.

7. A lock set for a door comprising:

a latch bolt assembly including a bolt movable between latching and a retracted positions;

retractor means supported by said housing member for reciprocal movement relative thereto between latching and retracted positions and connected to said bolt for moving said bolt between its positions upon reciprocal movement thereof;

axially movable and rotatable roll back means extending transverse of the direction of movement of said bolt and engaged with said retractor means for producing reciprocal movement thereof, the roll back means including a radially extending generally U-shaped surface; and an operating assembly comprising a hand operator having a locking slot formed in an axially extending portion thereof, locking means disposed within said hand operator including a plug portion rotatable relative to said operator, non-rotatable outside roll back means radially sandwiched between said hand operator and said auxiliary roll back means including a radially movable retainer member aligned with said locking slot and normally extending therethrough for locking said hand operator on said roll back means, said retainer member including a U-shaped surface generally radially aligned with the U-shaped surface of said auxiliary roll back means for maintaining said retainer member within said slot, and said plug including an axially extending cam surface engaging said auxiliary roll back means, with rotation of said plug resulting in movement of said cam surface relative to said auxiliary roll back means, with said cam surface providing a force to axially displace said auxiliary roll back means relative to said outside roll back means and thereby axially displaced the U-shaped surfaces relative to each other.

8. A lock set in accordance with claim 7 wherein said auxiliary roll back means includes a radially extending slot, with said cam surface extending axially within said slot.

9. A lock set in accordance with claim 8 including spring means attached to said retainer member for urging said retainer member radially in said slot.

10. A lock set in accordance with claim 9 wherein the cam surface is spiral-shaped.

11. A lock set in accordance with claim 7 wherein the cam surface is spiral-shaped.

12. A lock set in accordance with claim 7 including spring means attached to said retainer member for urging said retainer member radially into said slot.

13. A motion producing mechanism for use in a lock set comprising:

a first rotatable member having an axially extending spiral-shaped cam surface disposed at one end thereof; and a second rotatable member having a radial slot in an end thereof facing towards the cam surface of the first member, with the cam surface extending within the slot whereby initial rotation of the first member causes the spiral-shaped cam surface to drive the second member axially away from the first member and continued rotation of the first member causes concurrent rotation of the second member.

14. A motion producing mechanism in accordance with claim 13 wherein the first rotatable member is a plug of the lock set and the second rotatable member is a roll back member of the lock set.

* * * * *